United States Patent [19]

Otto

[11] 4,039,051

[45] Aug. 2, 1977

[54] DISC BRAKE CONSTRUCTION, ESPECIALLY FOR RAIL VEHICLES

[75] Inventor: Alfred Otto, Remscheid, Germany

[73] Assignee: Bergische Stahl-Industrie, Remscheid, Germany

[21] Appl. No.: 611,415

[22] Filed: Sept. 8, 1975

[30] Foreign Application Priority Data

Sept. 9, 1974 Germany ..... 2443095

[51] Int. Cl.[2] ..... B61H 13/24

[52] U.S. Cl. ..... 188/58; 188/72.1; 188/72.6

[58] Field of Search ..... 188/58, 59, 71.1, 72.1, 188/72.6, 106 F, 106 P, 153 R

[56] References Cited

U.S. PATENT DOCUMENTS

| | | | |
|---|---|---|---|
| 1,995,135 | 3/1935 | Williams et al. | 188/59 |
| 2,274,859 | 3/1942 | Eksergian | 188/59 |
| 2,792,082 | 5/1957 | Casey | 188/59 |
| 2,885,034 | 5/1959 | Holin | 188/59 |
| 3,027,976 | 4/1962 | Soddy | 188/59 |
| 3,604,539 | 9/1971 | Goods | 188/59 |

FOREIGN PATENT DOCUMENTS

| | | | |
|---|---|---|---|
| 78,675 | 4/1919 | Austria | 188/59 |
| 1,061,792 | 4/1954 | France | 188/72.6 |

*Primary Examiner*—George E. A. Halvosa
*Assistant Examiner*—Edward R. Kazenske
*Attorney, Agent, or Firm*—Walter Becker

[57] ABSTRACT

A disc brake construction, especially for rail vehicles, in which a bogie having at least one axle rotatable therein is provided with brake discs on the inner sides of the wheels on the axle. The disc brake construction embodies a brake shoe adjacent each disc, each of which is pivotally supported on a lever pivotally supported on the bogie. Brake actuating mechanism extending transversely of the bogie is operatively connected to and supported by the levers for actuating the levers to cause the shoes to engage the respective discs. A mechanical device can also be operatively connected to the levers for mechanically actuating the brakes. The entire brake structure, other than the discs on the respective wheels, is supported by the bogie on which the wheel axle, or axles, rotates.

6 Claims, 4 Drawing Figures

DISC BRAKE CONSTRUCTION, ESPECIALLY FOR RAIL VEHICLES

The present invention relates to a universal disc brake system for rail vehicles, especially partial lining-disc brake in which between two brake surfaces facing each other there is provided a spreading device for causing the brake linings to engage the braking surfaces, and in which the braking surfaces are formed by unilateral braking discs or axle braking discs with inwardly located friction surfaces, said unilateral braking discs or axle braking discs being located on the inner side of the wheels.

Braking discs in rail vehicles have been adapted by almost all railroad companies. The range of application relates, however, primarily to passenger traffic and vehicles, in other words to traffic and vehicles which require driving comfort or run at high speeds. In this connection, either shafts, axles, or wheel disc brakes are employed. The additional costs and weight are justified with this type of vehicles. However, it is considerably more difficult to equip normal freight cars with disc brakes because on one hand the brake discs cause considerably higher costs than block brakes and on the other hand, the driving speeds of freight cars are considerably lower than those of passenger cars. The required braking power can also normally be realized without difficulties by means of block brakes. The no doubt higher wear of block brakes is accepted in this connection. Very frequently, brake discs cannot be built into freight cars because the space between wheel and bogie-longitudinal beam prevents the installation of a double jar brake, or because when exchanging worn braking discs, the wheels must be pressed of the axles.

It is, therefore, an object of the present invention to provide a brake disc which on one hand can be realized at not much higher costs than the costs nowadays to be expended for customary block brakes which brake discs, however, on the other hand with regard to its weight can bring advantages and can take into consideration the respective space conditions of the bogie with which normally freight cars are equipped. In addition thereto, with the plurality of the freight car types it is necessary to create a brake disc which is universally applicable to all types of vehicles and which permits the exchange of brake discs and brake linings in a very simple manner.

These and other objects and advantages of the invention will appear more clearly from the following specification in connection with the accompanying drawings, in which.

The disc brake system according to the present invention is characterized primarily in that:

a. each brake lever has one end linked to the bogie or the vehicle, while
b. the other end is connected to a spreading device, and
c. the braking jaw carrying the brake lining is by means of an eye arranged at approximately the center of gravity of the brake lining linked to the brake lever, and
d. the spreading device comprises a braking cylinder which has its cylinder engaging a first brake lever and has its connecting rod engaging a second brake lever which engages the braking surface provided on the same axle.

Advantageously, with a two-axle bogie, the brake levers for the brake surfaces arranged adjacent to each other but on different axles are connected to each other by a braking beam, and the spreading device is arranged between the two brake beams. Expediently, for each axis there is provided a braking device between the braking beams.

The advantage of this disc brake system is seen above all in the fact that normally non-used space between the wheels and the axles of the vehicle or bogie is taken advantage of for mounting the disc brake and the actuating means therefor, whereas those sides of the wheels which are located toward the outside do not have to be equipped with brake discs so that the longitudinal beam of the bogie can move relatively closely as heretofore customary past the wheels. In addition thereto, the brake system according to the present invention has no greater weight than the comparative block brake device, but the wear is considerably less. In the meantime it has been proved in practice that the wear ratio of the block brake to the disc brake is approximately 4:1. Moreover, when employing disc brakes, the wheels are considerably less subjected to wear. It is known that block brake wheels have the tendency to develop tears, distortions or when bandaged, the band layers have the tendency to disengage. In addition thereto, the present invention has the great advantage that the normally organically bound brake linings of a disc brake do not form a brake dust which is electrically conductive as it occurs with block brakes having blocks of metal. This electrically conductive brake dust can affect the current passing through the rails and intended for the control systems, etc., and thus may also cause harmful effects upon the vehicle itself which in turn may affect the safety of the vehicle.

Figure 1:
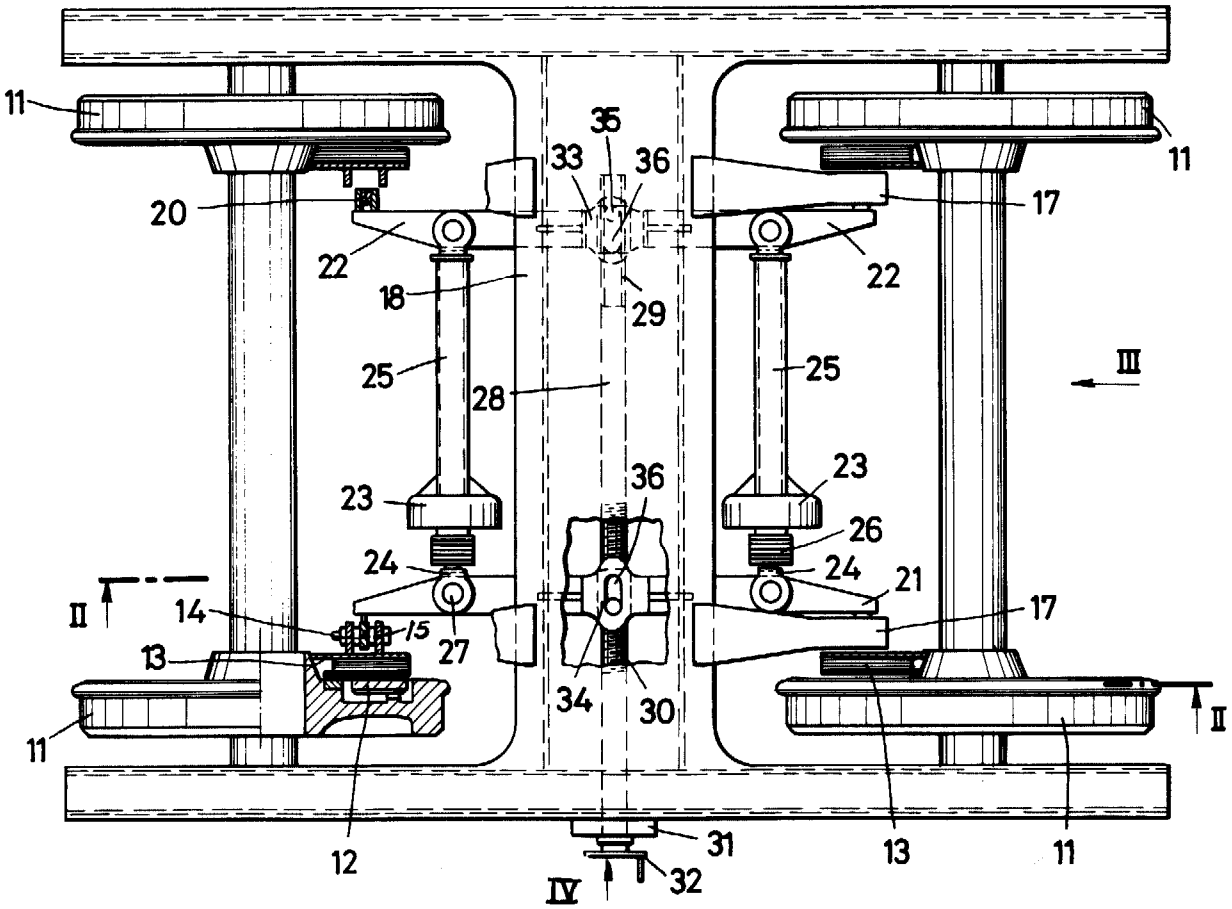
FIG. 1 is a top view of a two-axle bogie.
Figure 2:
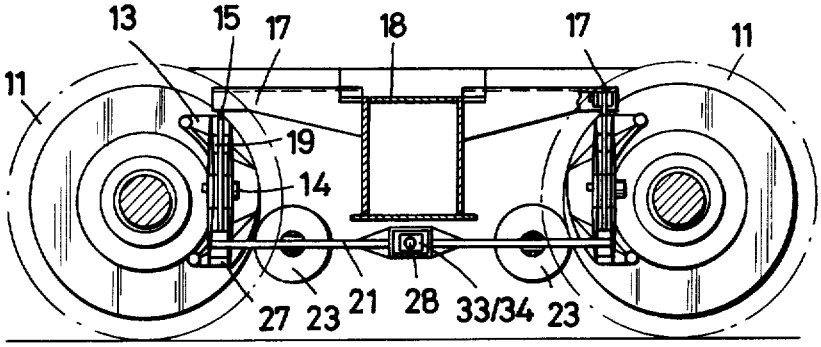
FIG. 2 represents a section taken along the line II—II of FIG. 1.
Figure 3:
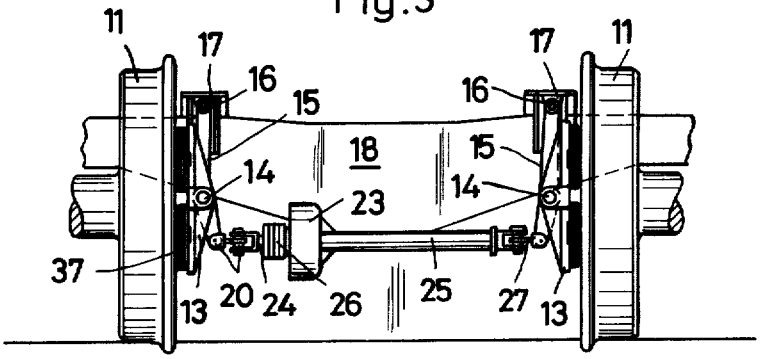
FIG. 3 is a view taken in the direction of arrow III of FIG. 1.
Figure 4:
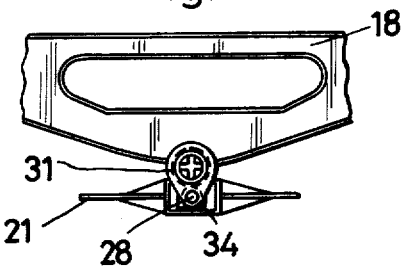
FIG. 4 is a view taken along the direction of the arrow IV.

Referring now to the drawings in detail, FIG. 1 shows a bogie with a manual brake system, as seen from the above. As will be evident from FIG. 1, all wheels 11 have their inner side provided with a brake disc 12 which is acted upon by a brake jaw 13. The brake jaws 13 are in conformity with FIGS. 2 and 3 linked to a brake lever 15 by means of an eye 14 arranged at least approximately within the center of gravity of the brake lining. The linkage point of the eye 14 on the brake lever 15 is located approximately within the lower third of the brake lever 15 which latter has its upper end 16 axis parallelly movably linked to the connecting supports 17 of the bogie 18. Adjacent the eye 14 of the brake jaw 13 there are provided friction surfaces (FIG. 2) which cooperate with the brake lever 15.

At the lower end of the brake lever 15 a brake beam 21 (FIG. 1) is arranged at 20, which beam 21 interconnects the two brake levers 15 which are arranged on one side of the bogie but pertain to different wheel axles. In this way, in each bogie two brake beams 21 and 22 are provided as shown in FIG. 1. As spreading device, there are provided two pneumatic cylinder piston systems 23 which are arranged between the two brake beams 21 and 22 while one spreading device each is associated with each wheel axle. The brake beam 21 is connected to the connecting rod 24, and the brake beam 22 is through the intervention of an extension rod 25 connected to the cylinder of the actuating cylinder piston system 23. There is furthermore provided a return spring 26. Connecting rod 24 and extension rod 25 are respectively through joints 27 linked to the lower ends 20 of the brake lever 15. The brake cylinder piston system 23 is thus by means of its connecting rods supported only by the brake levers 15 and is not connected to the bogie.

In addition to the air actuation by means of the pneumatic cylinder piston system 23 there is for each vehicle on each bogie provided a mechanical actuation, namely a manually operable brake which comprises a rod 28 rotatably journalled in the vehicle. This rod 28 has on one part 29 a left hand thread while its other part 30 is provided with a right hand thread, or vice versa. That end of rod 28 which projects from the vehicle has either directly or through a reducing transmission 31 connected thereto a manually operable wheel 32 for actuating said rod 28. Mounted on each thread 29,30 is a threaded block 33,34 respectively which by means of a mandrel or a similar extension 35 is located an oblong hole 36 of a box-like broadened portion of the brake beams 21 and 22.

The function of the brake is relatively simple and will be evident from the drawings. More specifically, for purposes of effecting a braking action, air is introduced into the brake cylinder piston system 23 whereupon the connecting rod 24 and the extension rod or extension tube 25 forces or spreads the brake beams 21 and 22 apart. As a result thereof, the brake levers 15 are pivoted about their upper joint or linkage connection 16 whereby the brake jaws 13 are pivoted in the direction toward the brake discs 12 so that the brake linings 37 will engage the brake surface and will brake the wheel. If in this connection the brake lining surfaces are not precisely parallel to the brake surface of the brake disc 12, the brake jaw is pivoted about the eye 14 so that in view of the brake surface 19 cooperating with the brake lever 15 the brake jaw will stay in this position so that also during the next braking operation the brake linings will engage the brake surface in a precisely parallel manner. If during the operation some wear should occur such wear will bring about an immediate although only a slight pivoting movement of the brake jaw holder about the eye 14 so that the brake linings will always be applied in a precisely plane manner against the brake surface of the brake disc 12.

When the braking operation is completed, the actuating cylinder piston system 23 is vented, and the return spring 26 moves the connecting rod 24 of the actuating cylinder piston system back to the original position with regard to the cylinder of this cylinder piston system. In this way the brake linings 37 are lifted off the brake disc 12. During braking operation, the oblong holes 36 of the manually operable braking device move upon the bolts or extensions 35 because the threaded blocks can, of course, not be displaced during the normal braking operation. For this reason, the bolts 35 etc., must engage the outer end of the oblong hole 36.

For purposes of actuating the manually operable braking device, the spindles 28 are turned by means of the hand wheel 32 whereby the bolts 35 are spaced from each other. As a result thereof, the brake beams 21 and 22 are displaced in the direction toward the braking surfaces so that the brake levers 15 are pivoted and the brake jaws 13 engage the brake disc 12. For purposes of reinforcing the manual braking moment, there is provided a step-down transmission 31.

Expediently, the brake discs 12 are employed as a divided construction so that these brake discs after wear occurred can relatively simply be exchanged. If also for the brake linings or brake jaws heretofore known designs can be employed, it is nevertheless suggested in view of the unilateral actuation of the wheels to employ a special construction in which the brake linings are relatively widely spaced from each other and can be arranged on the brake jaw.

It is, of course, to be understood that the present invention is, by no means, limited to the specific showing in the drawings but also comprises any modifications within the scope of the appended claims.

What is claimed is:

1. In a disc brake construction for rail vehicles in which at least two spaced axles having wheels thereon are rotatably supported on lateral axes in a bogie; a brake disc on, each wheel on the inner sides thereof, brake shoe means adjacent said discs on the inner sides of the discs, a brake lever on the inner sides of each brake shoe means and pivotally connected near end thereof on a fore and aft axis on the bogie, a fore and aft brake beam on each side of the bogie at the inner sides of the said levers on the same side of the bogie and pivotally connected with the respective levers, transversely extending power operated actuating means pivotally connected and operable for moving the levers about the pivotal connections thereof with the bogie, pivot means pivotally connecting each brake shoe means near the center of gravity thereof with an intermediate point on the respective lever, said actuating means comprising fluid operable cylinder-piston means having the cylinder connected to one of said beams and the piston connected to the other of said beams, mechanically operable means extending transversely between and connected to said beams, said mechanically operable means being accessible from at least one side of the bogie for manual operation to spread said beams and having a lost motion connection with at least one of said beams.

2. A disc brake construction according to claim 1 in which said actuating means comprises a pair thereof spaced in the fore and aft direction and each thereof being disposed near a said axle on the side thereof facing the other axle and each having one end connected to one of said beams and the other end connected to the other of said beams.

3. A disc brake construction according to claim 1 which includes friction surfaces effecting frictional engagement of each brake shoe means with the respective lever for supporting the shoe means on the lever for planar engagement with the respective disc.

4. A disc brake construction according to claim 1 in which said actuating means also comprises spring means for retracting the actuating means to withdraw the shoe means from the discs.

5. A disc brake construction according to claim 1 in which each shoe means is in the form of a segment of a disc and is disposed with the center of gravity in substantially the horizontal plane of the axle, each lever extending downwardly from the bogie to the point of pivotal connection of the lever to the respective shoe means.

6. In a disc brake construction for rail vehicles in which at least two spared axles having wheels thereon are rotatably supported on lateral axes in a bogie; a brake disc on each wheel on the inner sides thereof, brake shoe means adjacent said discs on the inner sides of the discs, a brake lever on the inner sides of each brake shoe means and pivotally connected near one end thereof on a fore and aft axis on the bogie, a fore and aft brake beam on each side of the bogie at the inner sides of said levers on the same side of the bogie and pivotally connected with the respective levers, transversely extending power operated actuating means pivotally connected and operable for moving the levers about the pivotal connections thereof with the bogie, pivot means pivotally connecting each brake shoe means near the center of gravity thereof with an intermediate point of the respective lever, said actuating means comprising fluid operable cylinder-piston means having the cylinder connected to one of said beams and the piston connected to the other of said beams, said actuating means comprising a pair thereof spaced in the fore and aft direction and each thereof being disposed near a said axle on the side thereof facing the other axle and each having one end connected to one of said beams and the other end connected to the other of said beams and mechanically operable means extending transversely between and connected to said fore and aft brake beams, said mechanically operable means being accessible from at least one side of the bogie for manual operation to spread said beams and having a lost motion connection with at least one of said beams, said mechanically operable means being disposed about midway between said axles in the fore and aft direction.

* * * * *